United States Patent [19]

Hoffmann

[11] Patent Number: 4,889,970

[45] Date of Patent: Dec. 26, 1989

[54] FACIAL SAUNA

[75] Inventor: Elmer L. Hoffmann, Wheaton, Ill.

[73] Assignee: Schwalm Electronics Inc., Highland Park, Ill.

[21] Appl. No.: 276,783

[22] Filed: Nov. 28, 1988

[51] Int. Cl.[4] ..... H05B 1/02

[52] U.S. Cl. ..... 219/271; 219/272

[58] Field of Search ..... 219/271, 272, 273, 274, 219/275, 276, 521, 535, 362, 436, 438

[56] References Cited

U.S. PATENT DOCUMENTS

| | | | |
|---|---|---|---|
| 3,707,971 | 1/1973 | Yamamoto | 219/272 |
| 3,951,610 | 4/1976 | Freebairn | 219/275 |
| 3,982,095 | 9/1976 | Robinson | 219/275 |

*Primary Examiner*—Teresa J. Walberg

*Attorney, Agent, or Firm*—Gerstman & Ellis, Ltd..

[57] ABSTRACT

A liquid heater for use as a facial sauna or the like includes a conductive heating bowl, an electric heating element for heating the bowl and a terminal board as part of a circuit for control of the heating element. An integral, one-piece bracket is attached to the underside of the bowl, the bracket defining a plurality of arms having free ends extending outwardly from the bowl. The terminal board is carried by the arm in spaced relation from the bowl, typically at the edges of the board, to provide an air gap for thermal insulation of the board from the heat generated. The bracket also defines a tunnel positioned against the underside of the bowl, with the heating element occupying the tunnel.

17 Claims, 1 Drawing Sheet

FIG. 1
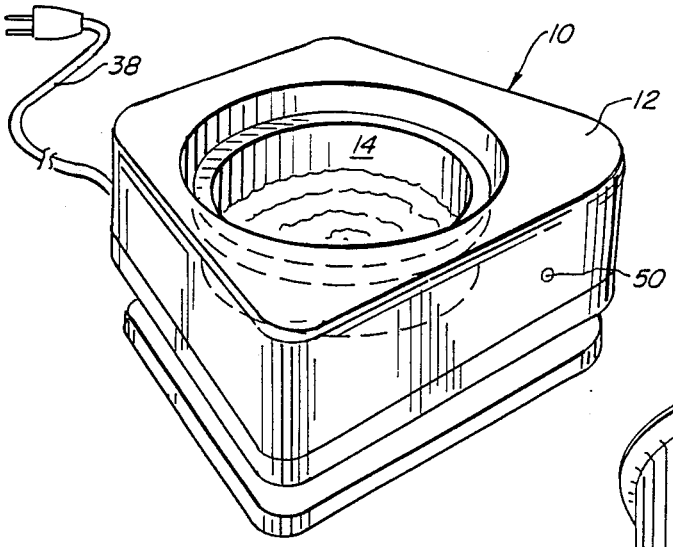
FIG. 2
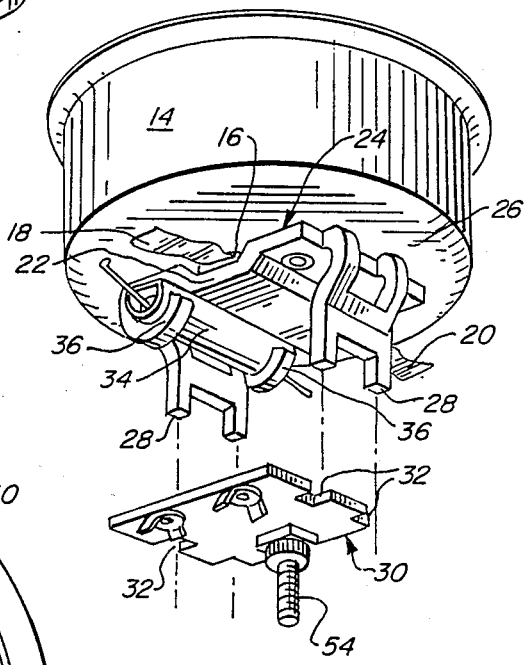
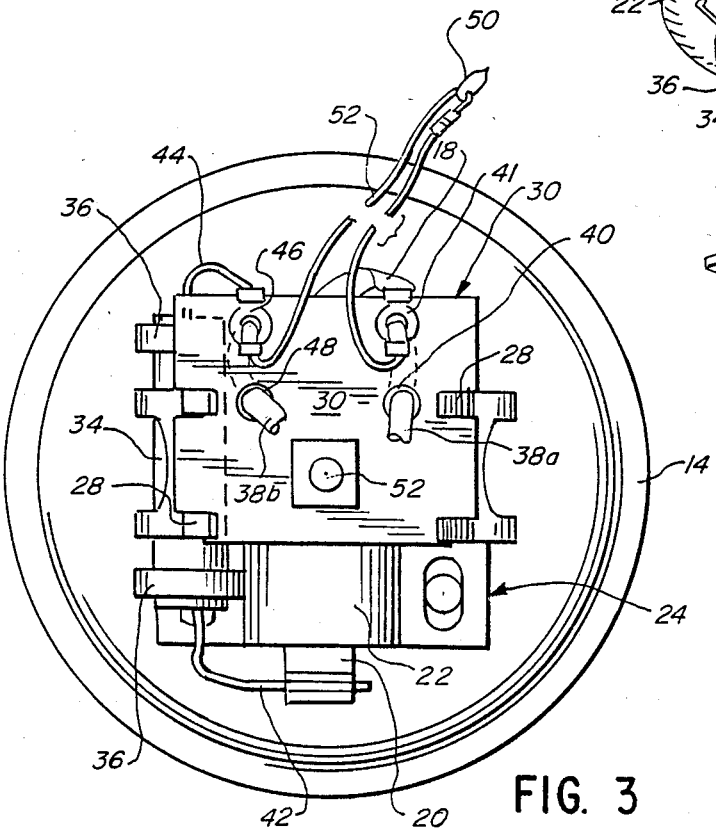
FIG. 3

FACIAL SAUNA

BACKGROUND OF THE INVENTION

Facial saunas are commonly available devices for providing steam to the face, making use of a small bowl in which water, with or without cosmetic additives, is boiled. In Frank, U.S. Pat. No. 3,470,719 and Frank et al. U.S. Pat. No. 4,621,641, among others, prior art liquid heaters of the type useable as facial saunas are disclosed.

Typically, a liquid heater of this type comprises a thermally conductive metal heating bowl, plus heating means, typically electric, for heating the bowl and its contents. In prior art designs the heating means includes a heating element and a terminal board as part of the control of the heating element. Specifically, the heating element may be of a known ceramic type, called a PTC heating element, which is typically positioned against the underside of the bowl. A typical PTC heating element is made of barium titanate, doped with a rare earth such as yttrium, being coated with a conductive surface.

Among the technical design problems that face such liquid heaters, it is desirable to protect the terminal board from excessive heating. This has been done with conventional heat insulation in prior art designs. Also, the plastic housing element must be protected from excess heating.

In accordance with this invention, an improved mounting for the bowl and electric heating system is provided, with the mounting being of increased cost effectiveness and further being capable of providing desired temperature control to both the terminal board and the heating element to economically provide a liquid heater usable as a facial sauna which exhibits optimum operating characteristics and useful life.

DESCRIPTION OF THE INVENTION

In this invention, a liquid heater comprises a conductive metal heating bowl, and electric means for heating the bowl. The electric heating means includes a heating element and a terminal board as part of the control of the heating element.

In accordance with this invention, an integral, one piece bracket is attached to the underside of the bowl. The bracket defines a plurality of arms having free ends extending outwardly from the bowl. The terminal board is carried by the arms in spaced relation from the bowl to keep the terminal board away from excess heating, its heat insulation thus preferably comprising air, which permits one to dispense with solid insulation as is found in some prior art designs.

The bracket also defines a tunnel-type aperture positioned against the underside of the bowl, with the heating element occupying the tunnel to be firmly retained against the bowl by the bracket.

The bracket typically also carries a thermostat or equivalent temperature control device which is electrically connected to control the heating means. As specifically shown, the thermostat is carried by a pair of added arms of the bracket which are curved to substantially surround and grip the thermostat.

Temperature control of the heating element may be effected by providing a bracket which is made by shaping a sheet of metal having a thickness of at least 0.1 and typically, no more than 0.3 inch. A bracket of such metal thickness can function has a heat sink and member for transferring heat to the cup, having adequate thickness to permit the increased migration and radiation of heat from the heating element, to prevent premature shutdown of PTC heating elements due to undesired increases in their temperature.

Additionally, the terminal board may define one or more apertures spaced from the board edges, while a power cord extends through the apertures to connect with the heating means. Thus, such aperture means can serve as a strain relief for the power cord.

DESCRIPTION OF THE DRAWINGS

In the drawings, FIG. 1 is a perspective view of a facial sauna made in accordance with this invention.

FIG. 2 is a perspective, exploded view of the heating bowl, bracket, and portions of the heating means used in the facial sauna of FIG. 1.

FIG. 3 is a bottom plan view, with portions broken away, of the facial sauna of FIG. 1 showing relationships of the respective parts.

DESCRIPTION OF SPECIFIC EMBODIMENT

Referring to the drawings, facial sauna 10 is disclosed in FIG. 1, comprising a housing 12 which encloses a metal heating bowl 14 for holding water or medicated liquid for boiling to provide steam for bathing the face.

Heating bowl 14 of sauna 10 is heated by a heating circuit including a PTC type heating element 16, of a commercially available type, connected at opposed ends to copper film conductor ribbons 18, 20. Heating element 16 is positioned against the underside of bowl 14 within a tunnel defined by a bent portion 22 of integral, one piece bracket 24, which is stamped from a sheet of aluminum, copper, or the like and riveted to the bottom surface 26 of bowl 14 in a leakproof manner. Alternatively, bracket 24 may be flat, and the bowl bottom may define a trough to together form an equivalent tunnel to receive heating element 16. Thus heating element 16 is firmly pressed against the underside of bowl 14 for good heat exchange contact therewith. Preferably, heating element 16 may also be in good heat exchange contact with bracket 24, but, if desired, a thermal or electrical insulator may be interposed between the two parts. The purpose of having bracket 24 in good heat exchange contact with heating element 16 is to allow bracket 24 to serve as a heat absorber and transfer member for maximum heat transfer to the cup. To this end, the thickness of bracket 24 may be about 0.125 inch, to provide good heat conductivity. This is particularly desirable when heating element 16 is of the PTC type, having a maximum temperature at which high output heating can be performed.

Bracket 24 also defines several arms 28 extending outwardly from bowl 24. A terminal board 30 is provided, with arms 28 fitting into peripheral notches 32 of terminal board 30 and retained therein in a conventional manner such as by snap fit or adhesive, to retain the terminal board in a position spaced from bowl 14. Thus, thermal insulation is provided to terminal board 30 from the heat of bowl 14 and heating element 16 by an insulating air gap, without necessarily using a solid insulation layer. Heat, migrating up arms 28 of bracket 24 to terminal board 30, has a chance to dissipate before arriving, so that the operation and useful life of board 30 is not diminished by excessive heating.

Additionally, bracket 24 defines a pair of added arms 36 which are curved to substantially surround and grip a thermostat 34. Power source line 38 is provided, being divided into pair of conductors 38*a*, 38*b* as shown in FIG. 3 for connection to both ends of the heating circuit.

Referring to FIG. 3, a heating circuit is defined by power line portion 38*a* which passes through aperture 40 of board 30 for strain relief purposes. Power line portion 38*a* then connects to terminal 41 on board 30. Terminal 41 connects with copper strip conductor 18 through conductive line 40 defined on terminal board 30. Copper strip or ribbon conductor 18 communicates with one end of heating element 16, which is contained within the tunnel defined by bent portion 22 of bracket 24, with conductive copper strip or ribbon 20 extending out of tunnel 22 on the other side of heating element 16.

Conductive ribbon 20 is in secured, electrically conductive relation with wire 42. Wire 42, in turn, connects with thermostat 34 at one terminal thereof. The other terminal of thermostat 34 communicates with wire 44, which, in turn, is secured to terminal 46 of terminal board 30. Power wire 38*b* also communicates with terminal 46, passing through aperture 48 in terminal board 30 prior to joining power wire portion 38*a* to extend out of casing 12. Thus, power wire portion 38*b* also is provided with strain relief by means of an aperture 48 as power wire portion 38*a* is provided strain relief by aperture 40.

Operating light 50 may be connected by a standard circuit 52, connected between terminals 41 and 46 to indicate when current is flowing in the heating circuit. Bolt 54 may be provided to assist in securing terminal board 30 bracket 24, and bowl 14 to casing 12.

The facial sauna of this invention may be manufactured with less cost than prior art designs because of the simplicity and effectiveness of bracket 24, which serves multiple purposes as described above, while it can be formed by a single metal stamping.

The above has been offered for illustrative purposes only, and is not intended to limit the scope of the invention of this application, which is as defined in the claims below.

That which is claimed is:

1. In a liquid heater comprising a conductive metal heating bowl, and electrical means for heating said bowl including a heating element and a terminal board as part of circuit means for control of said heating element, the improvement comprising, in combination:

an integral, one-piece bracket attached to the underside of said bowl, said bracket defining a plurality of arms having free ends extending outwardly from said bowl, said terminal board being carried by said arms in spaced relation from said bowl, said bracket and bowl also defining a tunnel positioned against the underside of said bowl, said heating element occupying said tunnel.

2. The liquid heater of claim 1 in which said bracket carries thermostat means electrically connected to control said heating means.

3. The liquid heater of claim 2 in which said bracket carries said thermostat means by a pair of added arms which are curved to substantially surround and to grip said thermostat means.

4. The liquid heater of claim 1 in which said heating element is of the PTC type.

5. The liquid heater of claim 4 in which said bracket is made by shaping of a sheet of metal having a thickness of 0.1 to 0.3 inch, to serve as a heat absorber and radiator to prevent premature shutdown of the PTC-type heating element.

6. The liquid heater of claim 1 in which said terminal board defines aperture means, spaced from the board edges, and a power cord extending through said aperture means to connect with the heating means, whereby said aperture means serves as a strain relief.

7. The liquid heater of claim 1 in which said arms carry said terminal board at edges thereof.

8. The liquid heater of claim 1, proportioned for use as a facial sauna.

9. In a liquid heater comprising a conductive metal heating bowl, and electrical means for heating the bowl, including a PTC-type heating element and a terminal board as part of circuit means for control of the PTC-type heating element, the improvement comprising, in combination:

an integral, one piece bracket attached to the underside of the bowl, said bracket defining a plurality of arms having free ends extending outwardly from the bowl, said terminal board being carried by said arms in spaced relation from the bowl, said bracket and bowl also defining a tunnel positioned against the underside of said bowl, said heating element occupying said tunnel, said bracket also defining a pair of added arms and carrying thermostat means electrically connected to control the heating means, said pair of added arms being curved to substantially surround and grip the thermostat means.

10. The liquid heater of claim 9 in which said bracket is made by shaping of a sheet of metal having a thickness of 0.1 to 0.3 inch, to serve as a heat absorber and radiator to prevent premature shutdown of the PTC-type heating element.

11. The liquid heater of claim 10 in which said terminal board defines aperture means, spaced from the board edges, and the power cord extending through said aperture means to connect with the heating means, whereby said aperture means serves as a strain relief.

12. The liquid heater of claim 11 in which said arms carry said terminal board at edges thereof.

13. The liquid heater of claim 12, proportioned for use as a facial sauna.

14. In a liquid heater comprising a conductive metal heating bowl, and electrical means for heating said bowl including a PTC-type heating element and a terminal board as part of circuit means for control of said heating element, the improvement comprising, in combination:

an integral, one-piece bracket attached to the underside of said bowl, said bracket defining a plurality of arms having free ends extending outwardly from said bowl, said terminal board being carried by said arms in spaced relation from said bowl, said bracket and bowl also defining a tunnel positioned against the underside of said bowl, said heating element occupying said tunnel, said bracket being made by shaping of a sheet of metal having a thickness of 0.1 to 0.3 inch, to serve as a heat absorber and radiator to prevent premature shutdown of the PTC-type heating element.

15. The liquid heater of claim 14 in which said terminal board defines said aperture means, spaced from the board edges, and a power cord extends through said aperture means to connect with the heating means whereby said aperture means serves as a strain relief.

16. The liquid heater of claim 14 in which said arms carry said terminal board at edges thereof.

17. The liquid heater of claim 14, proportioned for use as a facial sauna.

* * * * *